United States Patent [19]

Langlois et al.

[11] 4,173,990

[45] Nov. 13, 1979

[54] TEMPORARY FABRIC AND METHOD AND APPARATUS FOR WEAVING SAME

[75] Inventors: Guy B. Langlois; Raymond G. Spain, both of Huntington Beach, Calif.

[73] Assignee: Hitco, Irvine, Calif.

[21] Appl. No.: 886,266

[22] Filed: Mar. 13, 1978

[51] Int. Cl.[2] ..... D03D 47/02; D03C 13/00

[52] U.S. Cl. ..... 139/440; 139/456; 139/449

[58] Field of Search ..... 139/11, 116, 55.1, 456, 139/429, 440, 441, 442, 449

[56] References Cited

U.S. PATENT DOCUMENTS

| | | | |
|---|---|---|---|
| 782,570 | 2/1905 | Lacey | 139/55.1 |
| 858,136 | 6/1907 | Atkins | 139/456 |
| 3,311,137 | 3/1967 | Miangolarra | 139/449 |
| 3,416,573 | 12/1968 | Fournier | 139/446 |
| 3,430,664 | 3/1969 | Shimwell | 139/442 |
| 3,536,019 | 10/1970 | Honda et al. | 139/116 |
| 3,595,276 | 7/1971 | Wrzesien | 139/440 |

*Primary Examiner*—Henry Jaudon
*Attorney, Agent, or Firm*—Fraser and Bogucki

[57] ABSTRACT

A plurality of generally parallel, side-by-side warp tows of carbonaceous precursor material are interwoven with fill yarns forming a fabric of low density cross weave to facilitate handling of the warp tows for oxidation, carbonization and other processing thereof. A different fill yarn is interwoven with the warp tows from each of the opposite edges of the fabric so as to form a succession of generally V-shaped loops in each warp yarn with the loops of the two different warp yarns being staggered along the length of the fabric. Each loop of warp yarn is comprised of a pair of lengths of warp yarn which enter the fabric from spaced-apart locations along an edge of the fabric and undulate under and over the warp tows in a like sense which is opposite the sense of the undulations of the immediately adjacent loops prior to joining at a point across part but not all of the width of the fabric. When processing of the warp tows is completed, the fill yarns are easily removed simply by pulling on those portions of the fill yarns extending between the successive loops. Methods and apparatus for weaving the fabric employ spaced-apart members such as rotatable rollers for supporting the warp tows and reciprocating, out-of-phase heddle arrangement disposed between the rollers and engaging the warp tows to periodically momentarily lift alternate ones of the warp tows relative to the remaining warp tows and then momentarily lift the remaining ones of the warp tows relative to the alternate warp tows. Each time the warp tows are momentarily separated, a loop from each of the opposite fill yarns is placed between the separated warp tows such as by use of opposite rapier assemblies which employ hollow, elongated members for feeding in the warp yarns to form the loops.

6 Claims, 13 Drawing Figures

FIG. 1
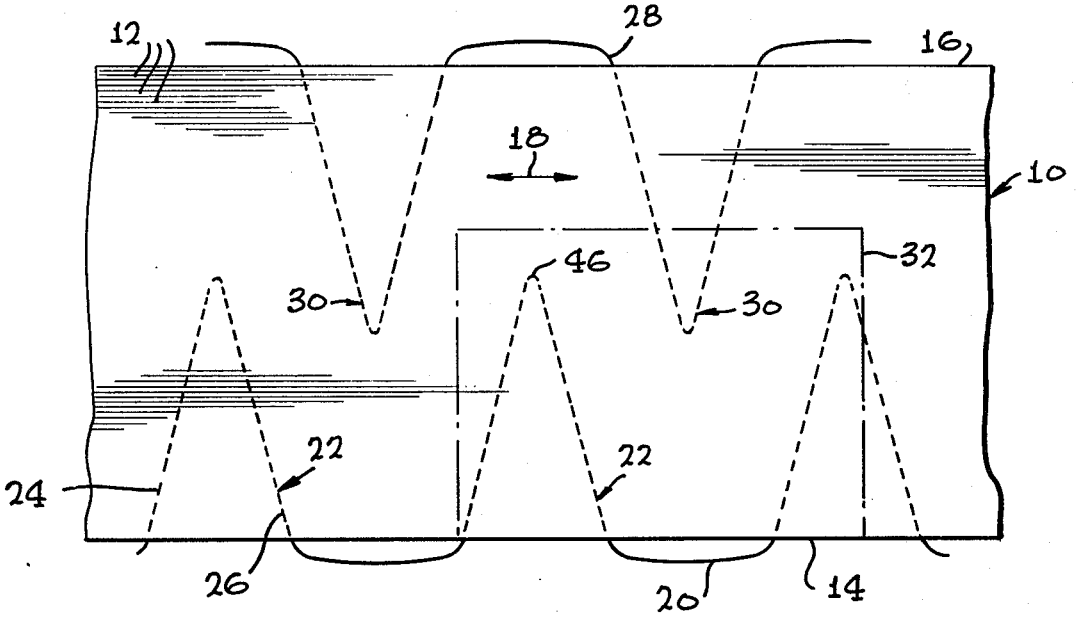
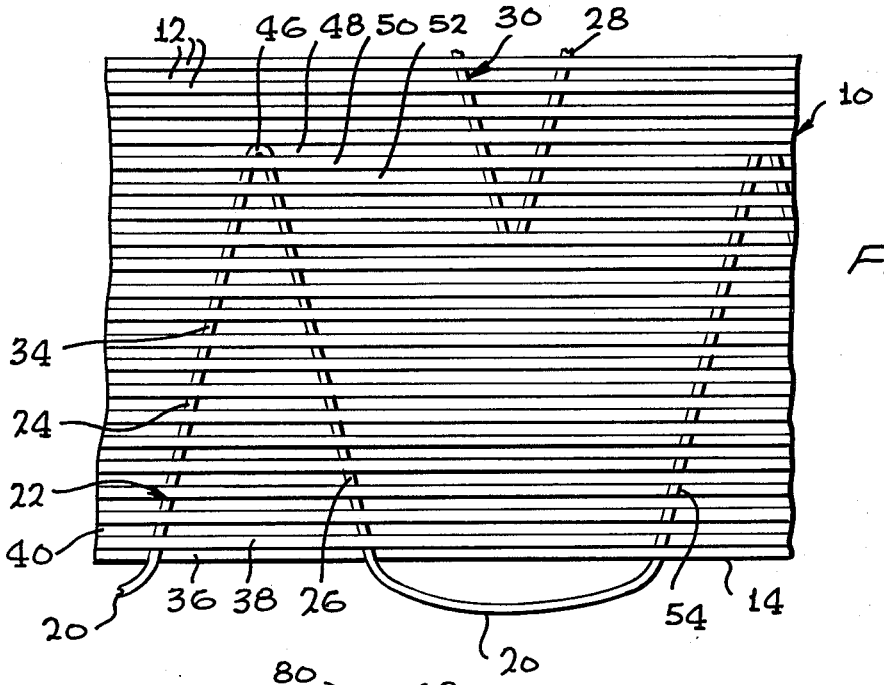
FIG. 2
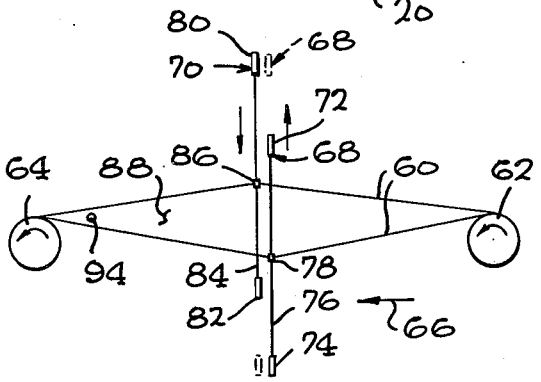
FIG. 4

AIR
AIR
11
11
130
116

TEMPORARY FABRIC AND METHOD AND APPARATUS FOR WEAVING SAME

BACKGROUND OF THE INVENTION

1. Field of the Invention

The present invention relates to woven fabrics and methods and apparatus for weaving the same, and more particularly to fabric formed by the low density cross weave of one or more fill members to hold a plurality of elongated warp members intact during the processing of the warp members.

2. History of the Prior Art

It is known in the art to provide a plurality of elongated warp members disposed in generally parallel, side-by-side relation with a low density cross weave in the form of one or more fill members to hold the warp members intact and thereby form a fabric to facilitate handling of the warp members during processing thereof. Examples of such fabrics and methods and apparatus for weaving the same are provided by U.S. Pat. Nos. 3,669,158, 3,955,256, 3,818,082, 3,925,587, 3,926,228, 3,673,035, 3,700,511, 3,726,751, 3,073,004, 3,779,789 and 3,859,158.

A low density cross weave is advantageous, for example, in the oxidation, carbonization and other processing of fibrous carbonaceous members, not only because of the difficulties imposed in handling the fibrous members as they are caused to undergo tortuous, complex paths but also because the fibrous members themselves tend to shrink and otherwise undergo distortion during the processing. The cross weave need not be of high density to satisfactorily hold together the warp members, and is preferably of relatively low density to facilitate the removal thereof when processing of the warp members has been completed. For example, U.S. Pat. No. 3,925,587 noted above discloses 2–8 picks per inch of the fill members, U.S. Pat. No. 3,926,228 noted above discloses 0.1–8 picks per inch of the fill member and U.S. Pat. No. 3,073,004 noted above discloses 1–20 fill yarns per inch.

The fill yarns may be interwoven with each and every one of the warp members as described in most of the above-noted patents, or they may be floated over and under various pluralities of the fill members so as to be interwoven only with an occasional one of the fill members. For example, in U.S. Pat. No. 3,818,082 noted above, the fill members are floated over 5 or 6 of the warp members at a time.

Regardless of whether the fill members are interwoven with each and every one of the warp members or only selected ones of the warp members, the fill members are typically difficult to remove from the warp members following processing of the warp members. Typically each fill member is interwoven with at least some of the warp members as it extends across the entire width of the array of warp members, whereupon the direction of separation of the warp members is reversed and the fill member thereby passes over and under the various warp members in opposite senses during the return of the fill member across the width of the array of warp members. Removal of the fill members usually requires that each fill member be cut at each edge of the fabric. The resulting severed lengths of fill members are then pulled out of the warp member with some difficulty. The procedure for removing the fill members is therefore a rather laborious one which is both time consuming and difficult and often results in waste of precious time such as where it is necessary to halt movement of the fabric for cutting and withdrawal of the fill members prior to movement of the fabric into further processing stages in a continuous process.

Accordingly, it would be advantageous to provide a fabric and methods and apparatus for weaving the same in which one or more fill members are easily interwoven with the warp members to form a low density cross weave which is easily removed from the warp members when desired and without the need to repetitively cut the full members.

BRIEF DESCRIPTION OF THE INVENTION

Woven fabrics in accordance with the invention utilize at least one continuous fill member which is interwoven with an array of generally parallel, side-by-side warp members so as to form a succession of loops of the fill member extending across at least a part of the width of the array of warp members. The various portions of each loop are interwoven with at least some of the warp members so as to undulate over and under each warp member in the same sense, thereby facilitating easy removal of the loop from the array of warp members when desired. At the same time the integrity of the woven fabric is preserved by reversing the sense of interweaving with the warp members from loop to loop of the fill member.

In one preferred embodiment of a woven fabric in accordance with the invention a pair of fill members are interwoven with the warp members from opposite edges of the array of warp members so as to form opposite successions of loops which are staggered relative to one another along the length of the warp members. Each loop of each fill member extends across slightly more than half the width of the warp member array.

Methods and apparatus for weaving in accordance with the invention initially dispose the warp members in generally parallel, side-by-side relation using opposite supports such as a pair of cylindrical rollers capable of advancing the warp members at a controlled speed. Selected ones of the warp members are repetitively and momentarily separated from the remaining ones of the warp members, first in one direction and then in an opposite direction. The momentary separations of the warp members occur between the pair of rollers or other supporting members and are accomplished as by use of reciprocating, out-of-phase heddle arrangements which carry the various warp members within apertures therein. Each time the warp members are momentarily separated from each other, a different portion of at least one fill yarn is inserted between the separated warp members to form a loop. When the warp members are then separated in the opposite direction, a different portion of the fill member is inserted to form another loop.

In preferred embodiments according to the invention a pair of fill members is used with loops of the different fill members being inserted from opposite sides of the array of warp members. The loops in the fill members are formed by appropriate apparatus such as an opposite pair of reciprocating rapier assemblies, each of which includes an elongated hollow member for receiving one of the fill members and feeding it into the space between momentarily separated warp members. Formation of each loop may be enhanced by an arrangement for providing a blast of air through a nozzle at the open end of the elongated hollow member so as to force out a short length of fill member for entrapment between the separated warp members as they advance over one of the rollers prior to withdrawing the rapier assembly and its included elongated hollow member from the momentarily separated warp members to complete the loop.

BRIEF DESCRIPTION OF THE DRAWINGS

The foregoing and other objects, features and advantages of the invention will be apparent from the following more particular description of a preferred embodiment of the invention, as illustrated in the accompanying drawings, in which:

FIG. 1 is a plan view of a woven fabric in accordance with the invention;

FIG. 2 is a detailed plan view of a portion of the woven fabric of FIG. 1;

FIG. 4 is a side view of the arrangement of FIG. 3;

DETAILED DESCRIPTION

Figure 3:
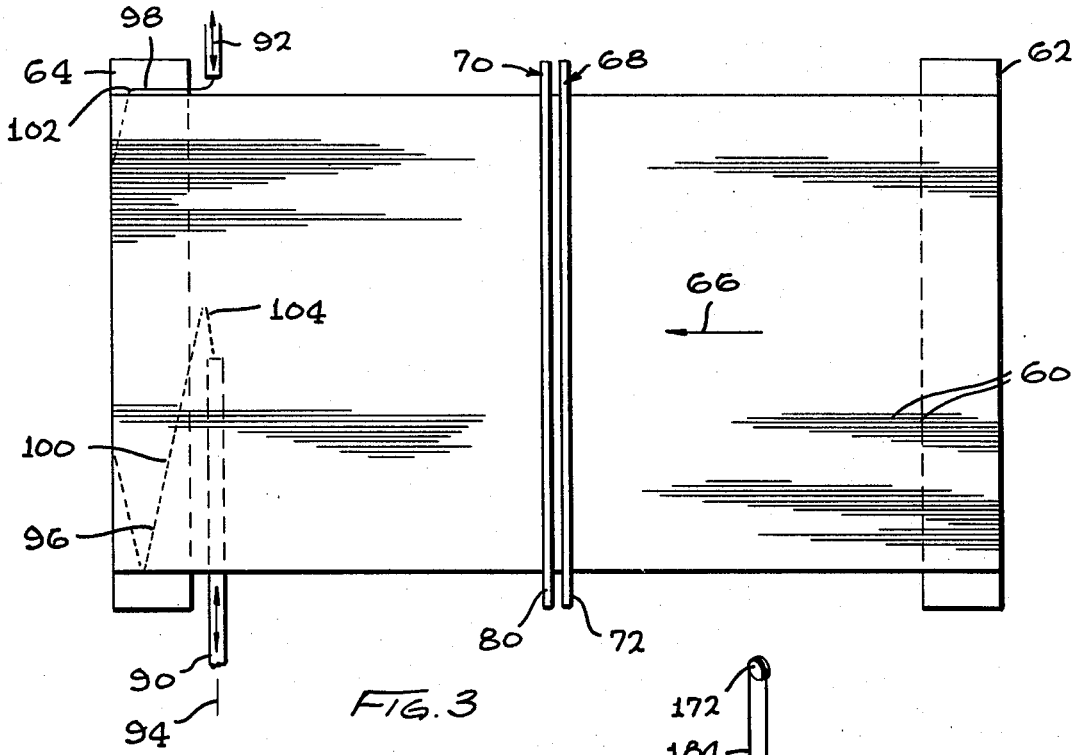
FIG. 3 is a top view of a simplified arrangement for weaving a woven fabric in accordance with the invention.

FIG. 1 depicts a woven fabric 10 in accordance with the invention. The fabric 10 includes an array of generally parallel side-by-side warp members 12 which are typically in tow, thread, yarn or similar elongated fibrous form. The warp members 12 are spaced side-by-side across the width of the fabric 10 between opposite edges 14 and 16 and form a generally planar array. In the example of FIG. 1 it is assumed that the warp members 12 are to be processed such as by oxidation or carbonization in the event they may comprise tows of carbonaceous material, and the fabric is assumed to move in either of the opposite directions shown by an arrow 18 over and under cylindrical rollers or similar processing devices.

A first elongated fill member 20, which typically comprises a yarn, thread or other elongated fibrous member, repeatedly extends into and out of the fabric 10 from the edge 16 along the length of the fabric to form a succession of loops 22. Each of the loops 22 is generally V-shaped and is comprised of two different lengths 24 and 26 of the fill member 20 which extend into the fabric 10 from spaced-apart locations at the edge 14 and join together at a point across part but not all of the width of the fabric 10. As described hereafter in connection with FIG. 2 the lengths 24 and 26 of each loop 22 are interwoven with at least some of the warp members 12 so as to undulate over and under the various warp members 12 in a like sense which is different from the sense of the undulations of the lengths 24 and 26 of adjacent ones of the loops 22. This results from alternate ones of the warp members 12 being separated from the remaining ones of the warp members 12 in first one direction as one of the loops 22 is formed and then in an opposite direction as the next loop 22 is formed.

A second fill member 28 extends into the fabric 10 from the opposite edge 16 to form a succession of loops 30 in a fashion similar to the first fill member 20. However the loops 30 of the second fill member 28 alternate with and are staggered relative to the loops 22 of the first fill member 20. The resulting pattern of loops 22 and 30 greatly aids in holding the various parallel warp members 12 intact over substantial fabric widths despite the relatively low density of the fill members along the length of the fabric 10. As in the case of the loops 22 the lengths of the second fill member 28 forming each loop 30 undulate over and under the warp members 12 in a like sense which is different from the sense of the undulations of the lengths forming adjacent ones of the loops 30. As in the case of the first fill member 20, this results from the alternate ones of the warp members 12 being separated from the remaining ones of the warp members 12 first in one direction and then in an opposite direction as each of the loops 30 is formed.

In the example of FIG. 1 one loop is formed in each fill member 20 and 28 before the direction of separation of alternate ones of the warp members 12 relative to the remaining ones of the warp members 12 is reversed. Consequently each loop 22 undulates under and over the warp members 12 forming the center portion of the fabric 10 in the same sense as does the immediately following loop 30.

FIG. 2 depicts a portion 32 of the fabric of FIG. 1 in substantially more detail so that the exact nature of the interweaving can be perceived. As seen in the lower lefthand portion of FIG. 2, the fill member 20 begins a first one 34 of the loops 22 by passing over a first warp member 36 defining the edge 14 of the fabric 10, then under a second warp member 38, then over a third warp member 40, and so on. The first one 34 of the loops 22 is comprised of a first length 24 and a second length 26 of the fill member 20 which enter the fabric 10 from spaced-apart points at the edge 14 and join together at a point 46 across part but less than all of the width of the fabric 10. It will be seen that the lengths 24 and 26 undulate over and under each of the warp members 12 so as to be interwoven with each particular warp member in a like sense. Thus the lengths 24 and 26 both pass over the first warp member 36, under the second warp member 38 and over the third warp member 40.

The first one 34 of the loops 22 is formed when even ones of the warp members 12 are raised above the odd numbered warp members 12. Thus the first one 34 of the loops 22 is formed when the second warp member 38 and other even numbered warp members are raised above the first warp member 36, the third warp member 40 and other odd numbered warp members. The immediately following loop 30 in the opposite fill member 28 is formed while the even numbered warp members are still raised above the odd numbered warp members. Consequently the loop 30 shown in FIG. 2 is interwoven with certain common warp members in the same sense as the first one 34 of the loops 22. For example the loop 34 and the loop 30 both pass over a warp member 48, under a warp member 50, over a warp member 52, and so forth.

Following formation of the loop 30 shown in FIG. 2, the relative positions of the warp members 12 are reversed such that the odd numbered warp members such as the warp members 36 and 40 are raised above the even numbered warp members such as the warp member 38. The fill member 20 subsequently enters the fabric 10 by passing under the first warp member 36, then over the second warp member 38, then under the third warp member 40, and so on as it forms a second one 54 of the loops 22 in the fill member 20. By the same token the second one 54 of the loops 22 passes under the warp member 52, over the warp member 50 and under the warp member 48 in an opposite sense or out-of-phase relationship relative to the loop 30 and the first one 34 of the loops 22.

It will be appreciated that since the various portions of each loop are interwoven with each of the warp members in a like sense, the fill members 20 and 28 are easily removed from the fabric 10 simply by pulling on the portions of the fill members extending outside of the opposite edges 14 and 16 and between the loops 22 and 30 without the need for cutting the fill members. At the same time it has been found that the fill members as so interwoven provide the warp member orientation required for such operations as oxidation and carbonization of carbonaceous fibrous material.

For some applications of the invention it may be desirable to use fill members made of a material which substantially disintegrates at the end of the processing sequence such as during carbonization to avoid the need for mechanical removal of the fill members. For most applications, however, fill members made of a material such as partially oxidized acrylic yarns which do not substantially deteriorate during carbonization are preferred, even though they must be mechanically removed.

In one example of a fabric 10 in accordance with the invention, approximately 640 tows of acrylic precursor of approximately 4000 denier are laid side-by-side to provide a fabric width of 54 inches. Each of the fill members 20 and 28 comprises oxidized acrylic yarn of approximately 2000 denier. The relatively low cross weave density is such that each of the loops in one of the fill members is approximately 9 inches wide at the point where the opposite lengths of the fill member forming the loop enter the fabric 10 from one of the opposite edges 14 and 16.

A method of and basic apparatus for weaving fabric in accordance with the invention such as the fabric 10 of FIGS. 1 and 2 are illustrated in conjunction with FIGS. 3 and 4. The apparatus of FIGS. 3 and 4 is simplified for clarity of illustration. A much more detailed and complete example of weaving apparatus according to the invention is set forth in FIGS. 5–12.

In the arrangement of FIGS. 3 and 4 elongated warp members 60 are disposed in generally parallel, side-by-side relationship so as to extend between a pair of opposite, generally cylindrical rollers 62 and 64 disposed to rotate about generally parallel axes. The rollers 62 and 64 are assumed to rotate in the direction shown by arrows in FIG. 4 such that the warp members 60 move in a direction from right to left as shown by an arrow 66 in FIG. 3. One or both of the rollers 62 and 64 can be driven to advance the warp members 60 thereover, or both rollers may comprise idler rollers in the event other rollers or devices not shown in FIGS. 3 and 4 are used to advance the warp members 60 from the roller 62 over and around the roller 64.

Disposed intermediate the rollers 62 and 64 are a pair of heddle assemblies 68 and 70. The heddle assembly 68 includes opposite top and bottom frames 72 and 74 respectively between which are disposed a plurality of heddle wires 76. Each of the wires 76 has an eyelet 78 or other aperture defining device for receiving an alternate one of the warp members 60. The heddle assembly 70 is of identical construction to the heddle assembly 68 and includes opposite top and bottom frames 80 and 82, a plurality of intermediate heddle wires 84 and a plurality of eyelets 86 for receiving the remaining ones of the warp members 60. The heddle assemblies 68 and 70 are shown in abbreviated form in FIGS. 3 and 4 in that a more complete example is provided by the apparatus of FIGS. 5–13.

The heddle assemblies 68 and 70 undergo reciprocating up and down motion in out-of-phase relation so as to raise the alternate ones of the warp members 60 relative to the remaining ones of the warp members 60 and then raise the remaining ones of the warp members 60 relative to the alternate ones of the warp members 60. As shown in FIG. 4 the heddle assemblies 68 and 70 are positioned such that the assembly 68 is in its lower position and the assembly 70 is in its upper position. When the heddle assemblies 68 and 70 are in the positions shown, the remaining ones of the warp members 60 are momentarily separated from and raised above the alternate ones of the warp members 60, defining a space 88 therebetween adjacent the roller 64. The positions of the heddle assemblies 68 and 70 are then reversed with the assembly 68 being raised to the upper position as shown in dotted outline in FIG. 4 and the assembly 70 being lowered to its lower position as shown in dotted outline in FIG. 4. When this happens the alternate ones of the warp members 60 are momentarily separated from and raised above the remaining ones of the warp members 60. This also creates the space 88 adjacent the roller 64, except that the relative positions of the warp members 60 are reversed.

As the warp members 60 are advanced from the roller 62 onto the roller 64 and the heddle assemblies 68 and 70 are reciprocated up and down in an out-of-phase relationship, a pair of opposite rapier assemblies 90 and 92 positioned to reciprocate into and out of the space 88 from opposite sides of the fabric along a common axis 94 form loops in a pair of fill members 96 and 98. The operation of the rapier assemblies 90 and 92 is such that the rapier assembly 90 moves into the space 88 to the position shown in FIG. 3 and then is completely withdrawn from the space 88, following which the rapier assembly 92 is moved into an extreme position within the space 88 and then withdrawn from the space 88, following which the process is repeated. As the rapier assembly 90 is moved into the space 88, a first portion of a loop 100 is formed as shown in FIG. 3. Despite the fact that the rapier assembly 90 moves along the axis 94 which is perpendicular to the direction of motion of the warp members 60, the resulting loop 100 is generally V-shaped since the warp members 60 continue to advance from the roller 62 to the roller 64 as the rapier assemblies 90 and 92 are moving. As seen in FIG. 3 the rapier assembly 92 has completed a loop at a point 102 and is paying out the fill member 98 as it advances along the length of the fabric being formed. When the rapier assembly 90 is withdrawn from the space 88, the rapier assembly 92 is then reciprocated into and out of the space 88 to form another loop, following which the positions of the heddle assemblies 68 and 70 are reversed. The heddle assemblies 68 and 70 are reversed each time the rapier assemblies 90 and 92 have each formed a loop.

The rapier assemblies 90 and 92 are preferably provided with means for shooting a short length of fill member from the open end thereof when the rapier is in its innermost position within the space 88. The apparatus of FIGS. 5–13 includes a pneumatic arrangement for accomplishing this. Such a length 104 is shown in FIG. 3. As each short length is shot from the open end of one of the rapier assemblies, it becomes quickly trapped between the spaced-apart warp members 60 as the warp members 60 are drawn over and into contact with the roller 64. This holds the innermost portion of the loop of fill member in place as the rapier assembly is withdrawn.

FIGS. 5–13 illustrate a preferred embodiment of apparatus 110 for weaving a woven fabric in accordance with the invention. The apparatus 110 includes a frame 112 of generally rectangular configuration having a pair of opposite sides 114 and 116, a top 118 and a bottom 120. A pair of heddle assemblies 122 and 124 are mounted for up and down sliding movement within opposite sets of heddle guides 126 mounted on the insides of the opposite sides 114 and 116 of the frame 112. The apparatus 110 includes a pair of rapier assemblies 128 and 130 mounted on and extending outwardly from the outer surfaces of the sides 114 and 116 respectively. The rapier assemblies 128 and 130 include elongated hollow rapiers which undergo alternating reciprocating motion in the manner described in connection with the arrangement of FIGS. 3 and 4 to feed fill members into the space between momentarily separated warp members. The warp members are pulled onto a roller assembly 132 which performs a function similar to the roller 64 of the arrangement of FIGS. 3 and 4 and which includes a roller 134, a second roller 136 mounted in parallel, spaced-apart relation relative to the roller 134 and a pair of pinch rolls 138 and 140 comprising hollow cylindrical members mounted adjacent the opposite ends of a shaft 142 and engaging the outer surface of the roller 134. The shaft 142 extends between and is rotatably mounted on the opposite sides 114 and 116 of the frame 112. The rollers 132 and 136 are mounted on shafts 144 and 146 respectively. The shafts 144 and 146 extend between and are rotatably mounted on the opposite sides 114 and 116 of the frame 112.

Figure 6:
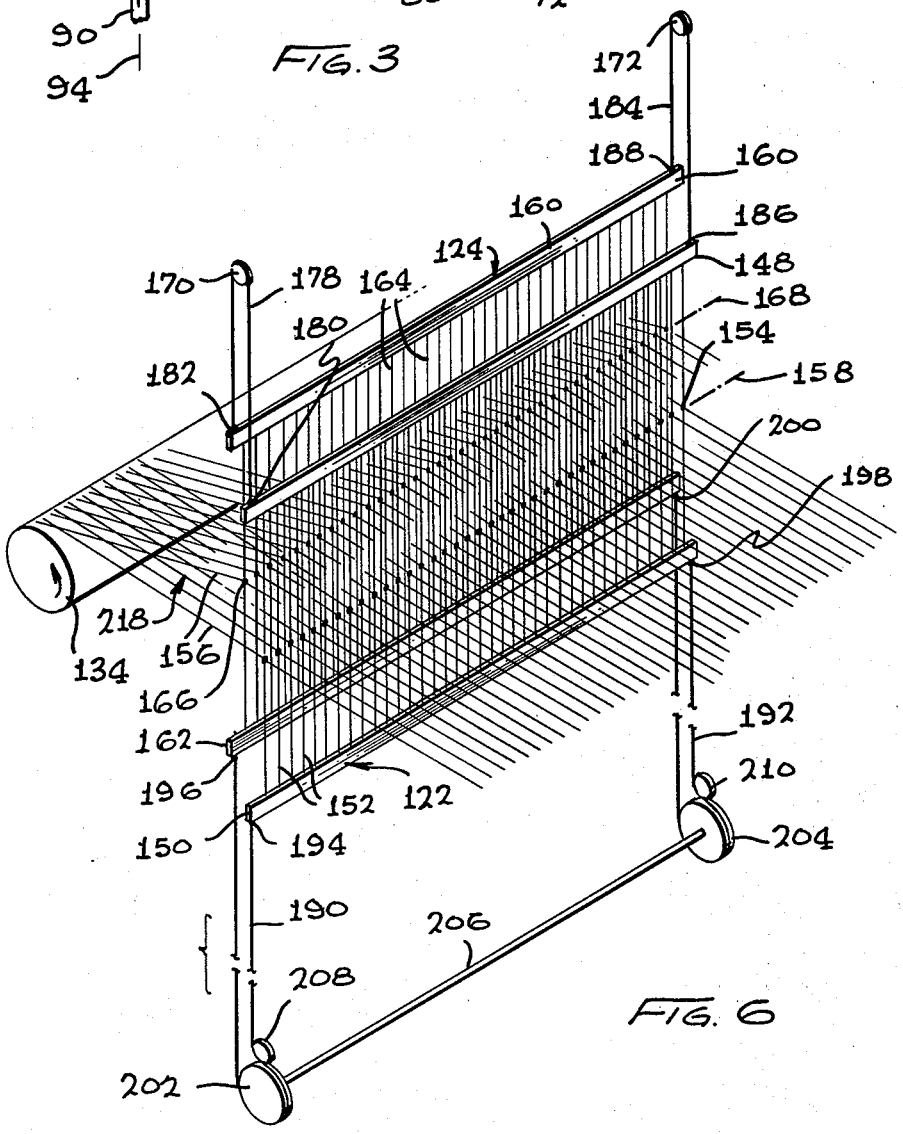
FIG. 6 is a perspective view of a portion of the apparatus of FIG. 5 showing the details of the heddle assemblies thereof.
Figure 5:
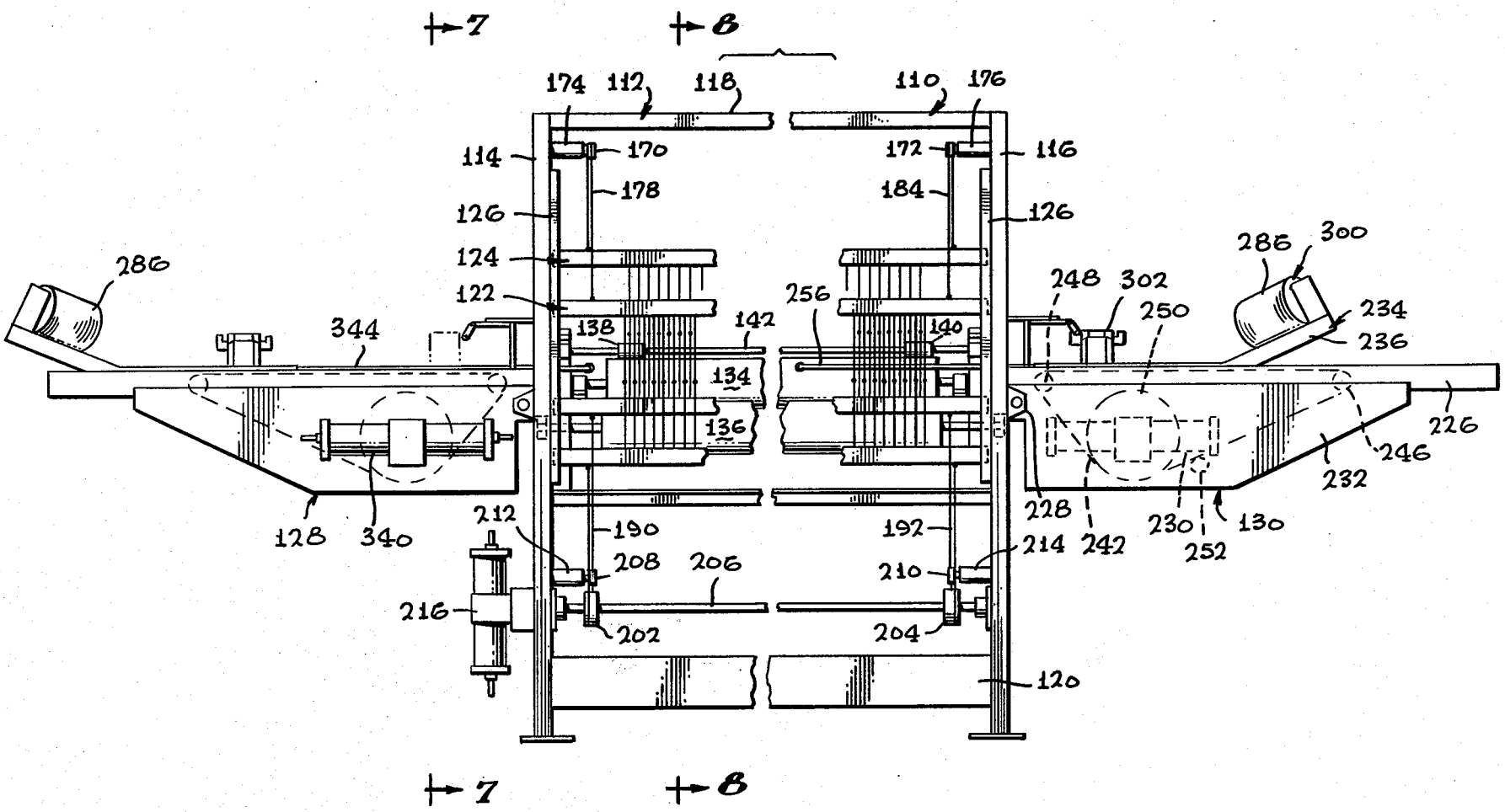
FIG. 5 is a front view of one preferred embodiment of apparatus for weaving a woven fabric in accordance with the invention.

The details of the heddle assemblies 122 and 124 are shown in FIG. 6 in addition to some of the other figures. The heddle assembly 122 includes an upper heddle frame 148 and a lower heddle frame 150. The frames 148 and 150 extend between the opposite sides 114 and 116 such that the opposite ends thereof are mounted within common ones of the heddle guides 126. The frames 148 and 150 are disposed in generally parallel, spaced-apart relation to each other. This relationship is maintained by a plurality of heddle wires 152 extending between the frames 148 and 150 in generally parallel, spaced-apart relation across the widths of the frames 148 and 150. At the center of each of the heddle wires 152 is an eyelet 154 defining an aperture for receiving one of a plurality of different warp members in the form of warp tows 156. The various eyelets 154 of the heddle wires 152 define an axis 158 which is parallel to the heddle frames 148 and 150.

The second heddle assembly 124 is of similar construction to the first heddle assembly 122 and includes an opposite pair of heddle frames 160 and 162 extending between and mounted in common ones of the heddle guides 126 and having an intervening plurality of heddle wires 164 having intermediate eyelets 166 defining an axis 168 parallel to the frames 160 and 162 and to the axis 158.

The heddle assemblies 122 and 124 are cyclically driven in reciprocating, out-of-phase relation by an arrangement which includes a pair of pulleys 170 and 172 mounted by standoffs 174 and 176 respectively to the insides of the sides 114 and 116 adjacent the tops of the sides. An elongated, flexible element in the form of a cable 178 extends at least part of the way around the pulley 170 and has one of its opposite ends coupled to one end of the heddle frame 148 via a cable clamp 180 and the other one of its opposite ends coupled to one end of the heddle frame 160 via a cable clamp 182. In like fashion the opposite ends of the heddle frames 148 and 160 are joined by a cable 184 extending at least part of the way around the pulley 172 and having a first one of the opposite ends coupled to the heddle frame 148 via a cable clamp 186 and a second one of the opposite ends coupled to the end of the heddle frame 160 via a cable clamp 188. The opposite ends of the lower heddle frames 150 and 162 are coupled to two different cables 190 and 192. The opposite ends of the cable 190 are coupled to the frames 150 and 162 via cable clamps 194 and 196 respectively. The opposite ends of the cable 192 are coupled to the frames 150 and 162 via cable clamps 198 and 200 respectively. The cables 190 and 192 extend at least partly around different ones of an opposite pair of drums 202 and 204 respectively which are mounted adjacent the opposite ends of an actuator shaft 206. The shaft 206 extends between and is rotatably mounted at the lower inside surfaces of the opposite sides 114 and 116 of the frame 112. An opposite pair of pulleys 208 and 210 mounted by standoffs 212 and 214 to the lower inside surfaces of the sides 114 and 116 respectively engage the cables 190 and 192 respectively at locations above the drums 202 and 204 to maintain a desired spacing between the opposite lengths of the cables 190 and 192 for proper operation of the heddle assemblies 122 and 124.

Rotation of the actuator shaft 206 and the included drums 202 and 204 causes movement of the cables 190 and 192 so as to reciprocate the heddle frames 150 and 162 up and down in an out-of-phase relationship. The cables 178 and 184 and the pulleys 170 and 172 enable the upper portions of the heddle assemblies 122 and 124 including the frames 148 and 160 to follow the movement of the lower frames 150 and 162. In this manner cyclic back and forth rotation of the actuator shaft 206 produces the desired up and down, out-of-phase motion of the heddle assemblies 122 and 124. The actuator shaft 206 is driven in such fashion by a rotary actuator 216 mounted on the side 114 and coupled to the shaft 206. In the present example the rotary actuator 216 is of the pneumatically driven type and comprises an actuator sold as Model No. AAC6.2-190-MS1-C by Ohio Oscillator Company.

The warp tows 156 extend from a roller or other suitable device (not shown in FIGS. 5–13) corresponding to the roller 62 of the arrangement of FIGS. 3 and 4 to the roller 134. The warp tows 156 assume a generally parallel, side-by-side relationship in the absence of action of the heddle assemblies 122 and 124. Alternate ones of the warp tows 156 extend through the eyelets 154 of the first heddle assembly 122 along the axis 158, while the remaining ones of the warp tows 156 extend through the eyelets 166 of the second heddle assembly 124 along the axis 168. As the heddle assembles 122 and 124 undergo reciprocating out-of-phase motion, the alternate ones of the warp tows 156 are momentarily separated from or raised relative to the remaining ones of the warp tows 156, following which the positions of the warp tows 156 are reversed with the remaining ones of the warp tows being momentarily separated from or raised relative to the alternate ones of the warp tows 156. Each time the warp tows 156 are separated, a space 218 is formed therebetween. The axis 158 defined by the eyelets 154 combines with the roller 134 to define a first plane in which the alternate ones of the warp tows 156 reside. In like fashion the axis 168 defined by the eyelets 166 combines with the roller 134 to define a second plane in which the remaining ones of the warp tows 156 reside. The two different planes of warp tows repeatedly pass through one another as the heddle assemblies 122 and 124 undergo the reciprocating, out-of-phase motion and repeatedly and momentarily define the space 218 into which the rapier assemblies 128 and 130 extend as described hereafter.

Use of a pair of heddle assemblies 122 and 124 is described herein for purposes of illustration only, and it will be understood by those skilled in the art that any number of heddle assemblies can be used as required or as dictated by design considerations. For example, each of the heddle assemblies 122 and 124 could comprise a pair of heddle assemblies disposed in generally parallel relation and either coupled to each other or arranged so as to undergo the same general motion. Use of multiple heddle assemblies is often desired for various reasons including the ability to maintain a larger spacing between adjacent eyelets in a given assembly.

In the present example operation of the heddle assemblies 122 and 124 and consequent movement of the warp tows 156 is facilitated by a comb assembly 220. The comb assembly 220 includes a plurality of combs 222 mounted in generally parallel, spaced-apart relation and generally vertically disposed along the length of a comb support 224 extending between and mounted on the opposite sides 114 and 116 of the frame 112 between the heddle assemblies 122 and 124 and the roller 134. The comb assembly 220 is mounted relatively close to the heddle assemblies 122 and 124 to maintain vertical alignment and separation of the warp tows 156 and to aid in preventing the warp tows 156 from becoming entangled as the warp tows are repeatedly intermeshed with one another in response to the reciprocating out-of-phase motion of the heddle assemblies 122 and 124. The individual combs 222 are of sufficient height so as to guide the warp tows 156 throughout the entire range of movement of the heddle assemblies 122 and 124.

Figure 8:
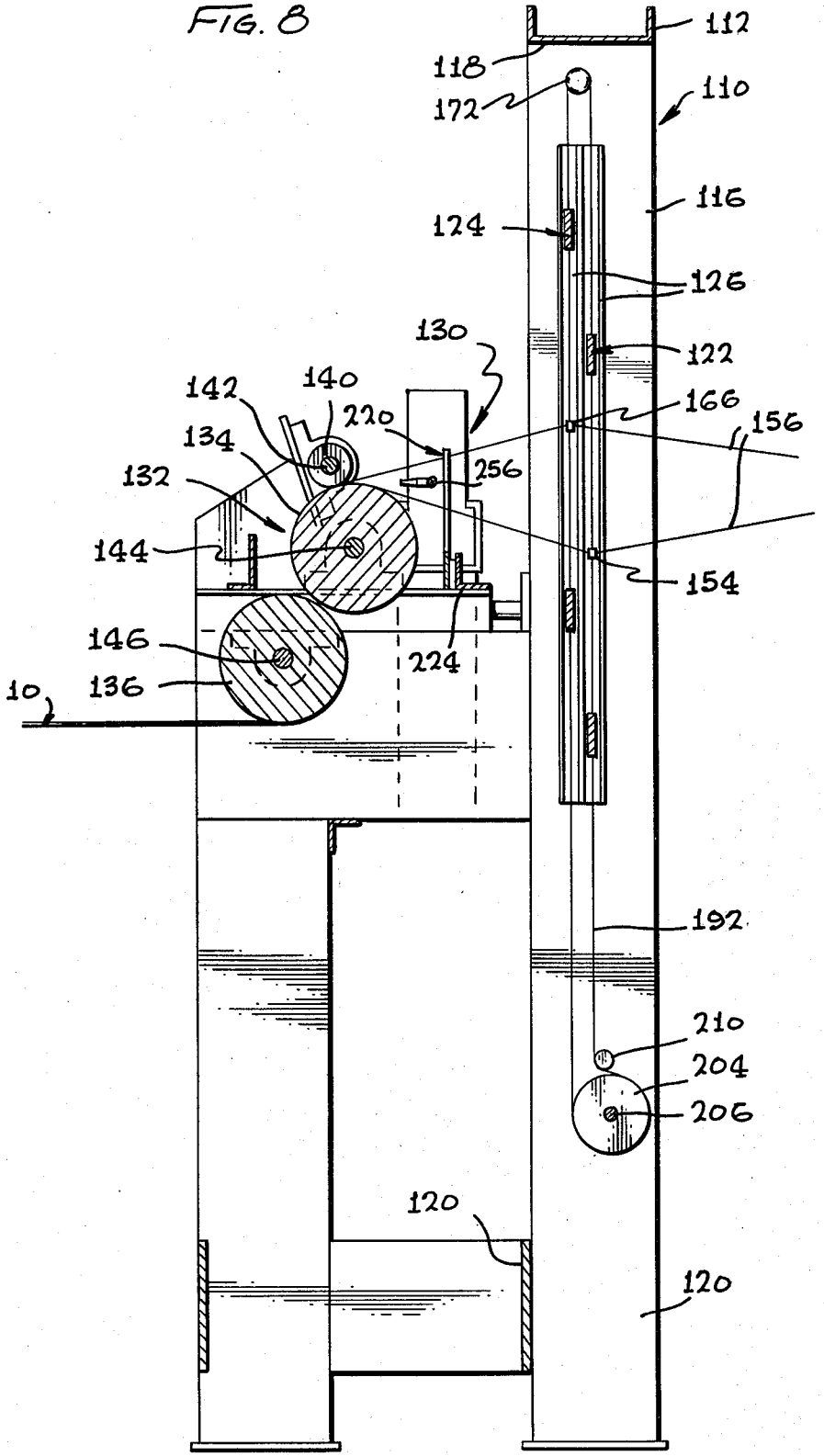
FIG. 8 is a sectional view of the apparatus of FIG. 5 taken along the line 8—8 of FIG. 5.
Figure 9:
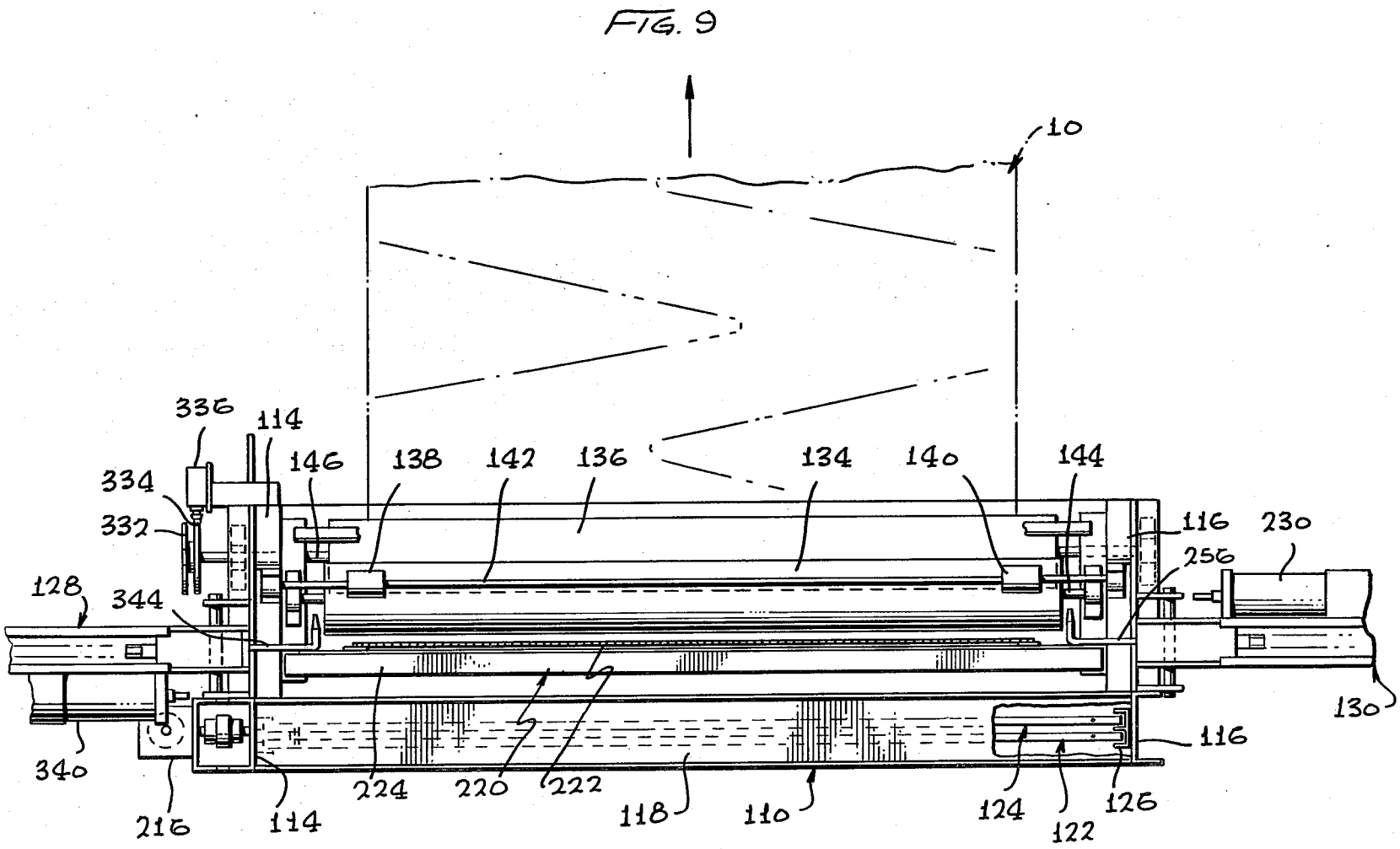
FIG. 9 is a top view of the apparatus of FIG. 5.

As best seen in FIG. 8 the warp tows 156 converge on the top of the roller 134 from which they extend over the roller 134 and onto and under the roller 136. In the present example the weaving apparatus 110 is assumed to comprise one stage in a continuous process such that the warp tows 156 are driven or fed from the preceding stage through the weaving apparatus 110 to the immediately following stage which aids in pulling the warp tows 156 through the apparatus 110. For this reason the rollers 134 and 136 are described as idler rollers in the present example. However, one or both of the rollers 134 and 136 could be driven as desired.

Th roller 134 corresponds to the roller 64 of the arrangement of FIGS. 3 and 4 and serves to receive the warp tows 156 after they are separated and interwoven with fill yarns as described hereafter. The roller 136 is needed principally to permit the woven fabric to exit the apparatus 110 along a generally horizontal path. The shaft 142 is disposed relatively close to the roller 134 so that the pinch rolls 138 and 140 rest against the outside surface of the roller 134. As such, the pinch rolls 138 and 140 rest on the opposite outer edges of the woven fabric including the portions of the fill members extending outside of the opposite edges of the fabric and between the loops of the fill members. This action serves to momentarily hold the fill members in place on the outside surface of the roller 134 to facilitate feeding of the fill members into the space 218 as subsequent loops in the fill members are formed.

Figures 10, 11, 12:
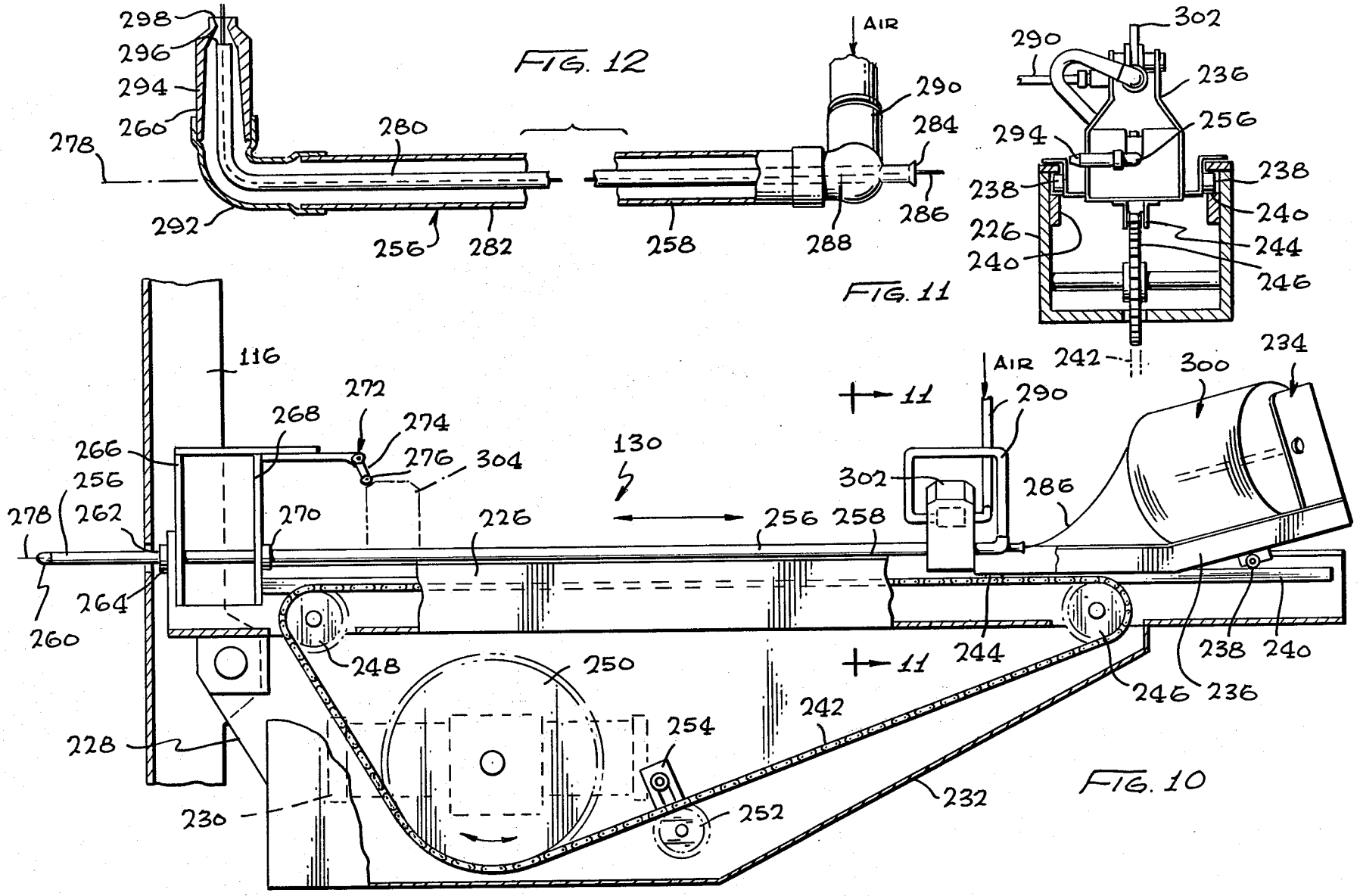
FIG. 10 is a side view, partly broken away, of one of the rapier assemblies of the apparatus of FIG. 5.
FIG. 11 is a sectional view of the rapier assembly of FIG. 10 taken along the line 11—11 of FIG. 10.
FIG. 12 is a side view, partly broken away, of a portion of the rapier assembly of FIG. 10.

The rapier assemblies 128 and 130 are virtually identical in construction. Accordingly only the rapier assembly 130 which is shown in FIGS. 10–12 need be described in detail. The rapier assembly 130 includes an elongated, hollow guide assembly 226 having one end thereof coupled to the side 116 of the frame 112 and extending outwardly from the side 116 in a generally horizontal direction. The guide assembly 226 is supported in part by a guide frame 228 coupled to the side 116 below the guide assembly 226. The guide frame 228 supports a rotary actuator 230 and part of an arrangement for driving the rapier assembly 130 including a hollow guard 232 extending downwardly from the bottom of the guide assembly 226.

A trolley assembly 234 adapted to undergo reciprocating linear motion along the guide assembly 226 includes a trolley frame 236 having opposite pairs of bearing guides 238 which engage and roll along an opposite pair of bearing runners 240 adjacent the top of the guide assembly 226. The bearing guides 238 roll along the runners 240, permitting the trolley assembly 234 to undergo linear motion along the top of the guide assembly 226. This motion is provided by an endless roller chain 242 which is coupled to the underside of the trolley assembly 234 via attached links 244 and which extends over an opposite pair of idler sprockets 246 and 248 pivotably mounted within the hollow interior of the guide assembly 226. The chain 242 extends downwardly from the opposite idler sprockets 246 and 248 and into the interior of the guide 232 where it engages and is driven bidirectionally by a sprocket 250 coupled to the rotary actuator 230. An idler sprocket 252 mounted on a spring loaded chain tensioner frame 254 serves to keep the chain 242 relatively taut with a desired amount of tension.

It will be seen that as the rotary actuator 230 drives the sprocket 250 in opposite directions, the resulting motion of the chain 242 causes the trolley assembly 234 to reciprocate along the top of the guide assembly 226. This motion is also imparted to a rapier 256 having one end 258 thereof coupled to the trolley assembly 234 and an opposite end 260 thereof disposed for movement into and out of the space 218 between the momentarily separated warp tows 156. The end 260 of the rapier 256 is supported by ball bearings 262 within a guide 264 mounted within a bracket 266. The bracket 266 and a second bracket 268 are mounted on the guide assembly 226 and the side 116 of the frame 112. The bracket 268 also mounts a ball bearing guide 270 which aids in supporting the rapier 256. The bracket 268 terminates in a roller tripper 272 comprising a pivotably mounted arm 274 and attached roller 276. As the trolley assembly 234 moves back and forth along the guide assembly 226 under the action of the chain 242, the rapier 256 slides within and is supported by the guides 264 and 270, providing the rapier 256 with reciprocating linear motion along an axis 278.

The details of the rapier 256 are shown in FIG. 12. The rapier 256 includes a hollow inner tube 280 disposed within the hollow interior of a larger outer tube 282 in generally concentric relation. At the end 258 of the rapier 256, the tube 280 terminates in an open end 284 for receiving an elongated fibrous fill member in the form of a yarn 286. The space within the hollow interior of the outer tube 282 surrounding the inner tube 280 is coupled via a coupling 288 to a tube 290. The portion of the outer tube 282 adjacent the end 258 of the rapier 256 is secured within a portion of the trolley frame 236 as shown in FIG. 10. The opposite end of the outer tube 282 terminates in a 90° elbow 292 coupled to a hollow nozzle 294. The inner tube 280 extends through the interior of the elbow 292 and terminates within the nozzle 294 in an open end 296 adjacent the inside of an open end 298 of the nozzle 294.

The fill yarn 286 extends through the open end 284 into the inner tube 280 from a yarn bobbin 300 mounted on the top of the trolley frame 236. The bobbin 300 is arranged so that yarn therefrom can be continuously drawn through the open end 284 and into the inner tube 280 of the rapier 256. In actual practice an arrangement for mounting a pair of bobbins on the trolley assembly 234 is preferred so that as one bobbin is depleted and fill yarn is then drawn from a second bobbin, the first bobbin can be replaced. The fill yarn extends through the inner tube 280 and out the open end 296 thereof where it exits the nozzle 294 by passing through the open end 298 thereof. As the rapier 256 undergoes reciprocating linear motion along the axis 278, the nozzle 294 is moved into and out of the space 218 between the separated warp tows 156 to form loops in the fill yarn 286. Each time the rapier 256 travels to its innermost position within the space 218, it is desirable to shoot a small portion of the fill yarn 286 out of the nozzle 294 so that it can be trapped between the warp tows 156 as they are wound onto the outer surface of the roller 134, to facilitate withdrawal of the rapier 256 from the space 218 to complete formation of the loop of fill yarn. This is accomplished by directing a momentary blast of air from a tube 290 through the coupling 288 and along the space between the inner tube 280 and the outer tube 282 to the nozzle 294. At the nozzle 294 the blast of air exits the open end 298 quickly, taking a portion of the length of the fill yarn 286 with it due to the venturi effect of the nozzle 294. The tube 290 is coupled to a source of pressurized air via an air valve 302 mounted on the top of the trolley frame 236. Each time the rapier 256 reaches its inner limit of travel, the air valve 302 assumes a position shown by the dotted outline 304 in FIG. 10. In this position the roller tripper 272 at the outer end of the bracket 268 engages and actuates the air valve 302 long enough to allow a quantity of the pressurized air to pass through the rapier 256 and out the nozzle 294.

Figure 7:
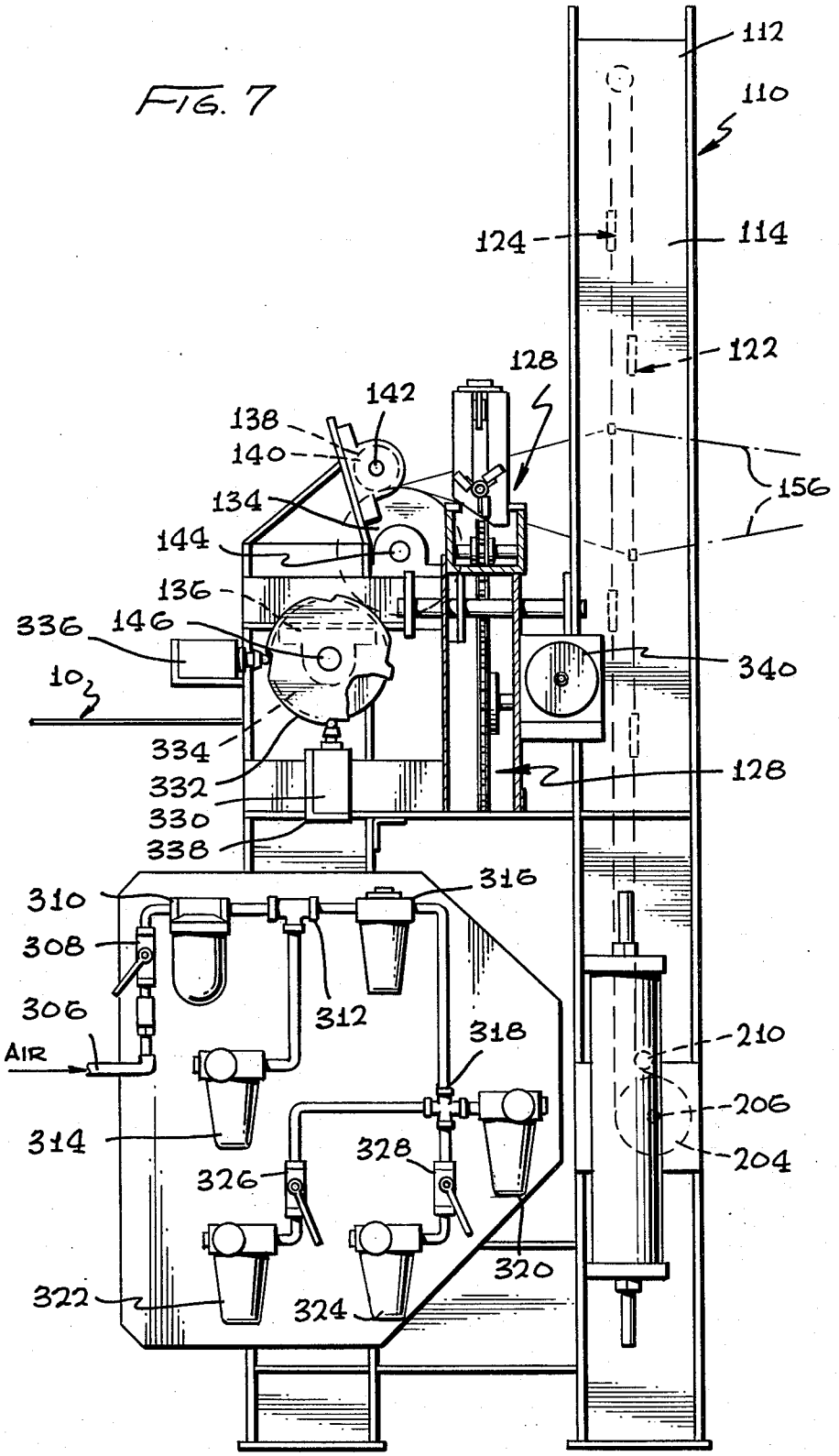
FIG. 7 is an end view of the apparatus of FIG. 5 taken from the line 7—7 of FIG. 5.
Figure 13:
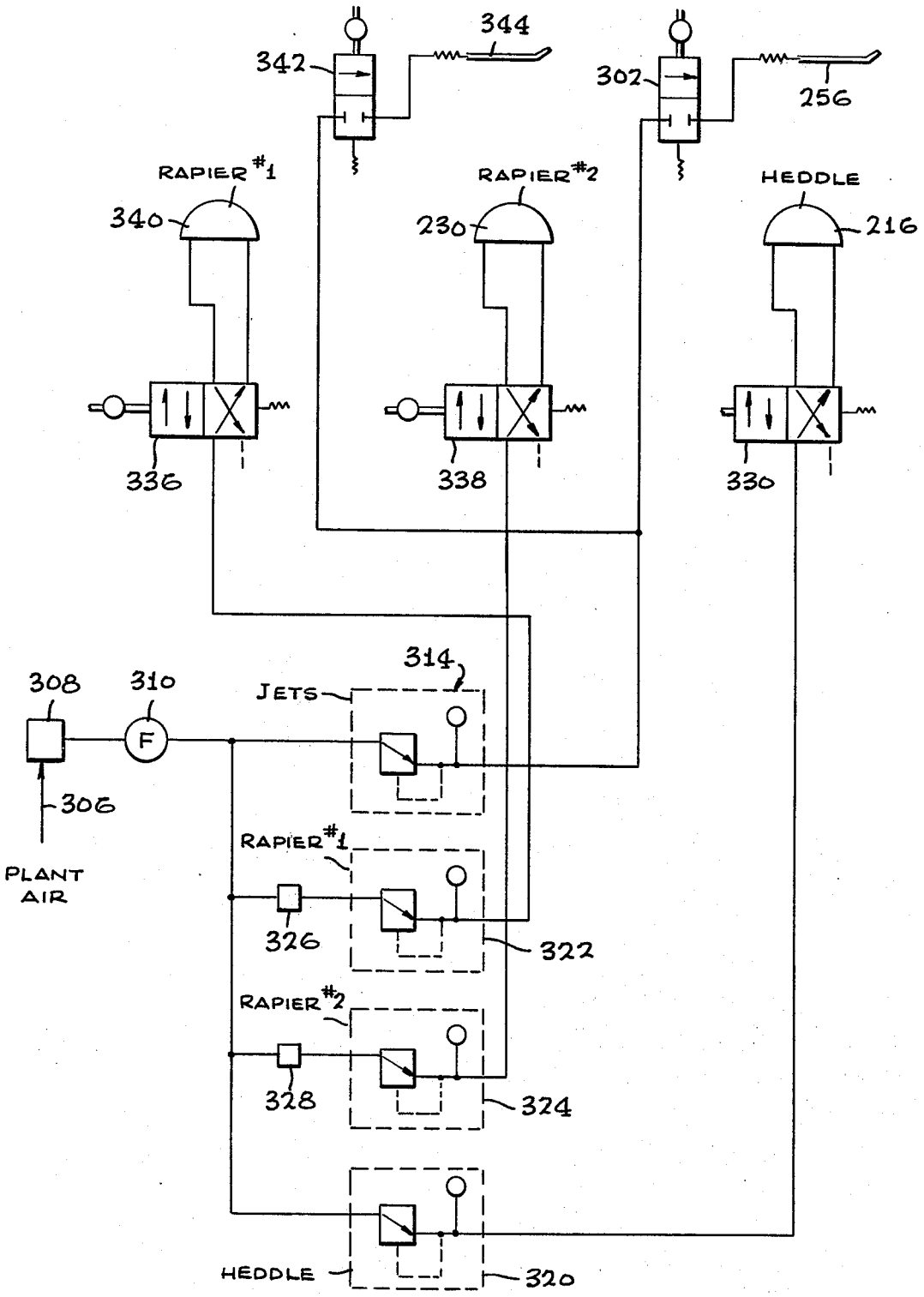
FIG. 13 is a schematic diagram of the pneumatic circuit of the apparatus of FIG. 5.

The rotary actuator 216 for the heddle assemblies 122 and 124 and the two rotary actuators for the rapier assemblies 128 and 130, which for purposes of the present example comprise actuators sold as Model No. 8AC6.2-370-MS1-C by Ohio Oscillator Company, are operated by a pneumatic circuit shown in FIG. 7 and schematically in FIG. 13. Referring to FIG. 7 pressurized air (approximately 80 psi) is introduced into a tube 306 from which it flows through a valve 308 and a filter 310 which removes water and oil from the air to a tee 312. The tee 312 couples the air via a pressure regulator 314 to each of the rapier assemblies 122 and 124 as well as through an oiler 316 to a cross 318. The oiler 316 adds a small quantity of oil vapor to the entering air to lubricate subsequent parts of the pneumatic system. From the cross 318 the entering air is applied to a heddle pressure regulator 320 and to a pair of rapier pressure regulators 322 and 324 via valves 326 and 328 respectively. The regulators 320, 322 and 324 regulate the pressure of the air as necessary prior to applying the air through control valves to the rotary actuators for the heddles and the rapiers. The control valve for the heddles comprises a valve 330 mounted on the outside of the side 114 so as to engage a first rotary cam 332 mounted on the shaft 146 for the roller 136. A second rotary cam 334 also mounted on the shaft 146 engages a pair of valves 336 and 338. The valve 336 serves as the control valve for the first rapier assembly 128. The valve 338 serves as the control valve for the second rapier assembly 130. The valves 336 and 338 are disposed 90° apart relative to the cam 334. Consequently the rapier assemblies 128 and 130 are out-of-phase in their reciprocating motion as previously described. With each 180° of rotation of the roller 136 and the included cams 332 and 334, each of the rapier assemblies 128 and 130 moves into and out of the space 218 between the momentarily separated warp tows 156. At the end of each such 180° cycle, the cam 332 operates the heddle valve 330 to reverse the positions of the heddle assemblies 122 and 124 in preparation for the next in and out movement of each of the rapier assemblies 128 and 130 during the next half revolution of the roller 136. The cams 332 and 334 are shaped to prevent interference between the rapier assemblies 128 and 130 by insuring that each rapier assembly has completed its in and out movement before the other rapier assembly is moved in and out of the space 218. The cams 332 and 334 are also designed to provide reversal of the heddle assemblies 122 and 124 during a time in which neither of the rapier assemblies 128 and 130 is undergoing movement.

FIG. 13 shows that the output of the pressure regulator 322 is coupled to a rotary actuator 340 for the rapier assembly 128 via the valve 336. Similarly the output of the pressure regulator 324 is coupled to the rotary actuator 230 for the rapier assembly 130 via the valve 338. The output of the pressure regulator 314 is coupled through the valve 302 on the trolley assembly 234 for the rapier assembly 130 to the rapier 256. In like fashion the pressure regulator 314 is also coupled through a valve 342 mounted on the other rapier assembly 128 to a rapier 344 within the rapier assembly 128. The output of the pressure regulator 320 is coupled through the valve 330 to the rotary actuator 216 for the heddle assemblies 122 and 124.

While the invention has been particularly shown and described with reference to preferred embodiments thereof, it will be understood by those skilled in the art that the foregoing and other changes in form and details may be made therein without departing from the spirit and scope of the invention.

What is claimed is:

1. Apparatus for interweaving at least one elongated fibrous fill member with a plurality of elongated fibrous warp members to form a fabric for processing of the warp members comprising the combination of frame means, at least one generally cylindrical roller rotatably mounted on the frame means and adapted to support a plurality of elongated fibrous warp members, a pair of heddle arrangements slidable mounted on the frame means and each including a plurality of apertured members disposed adjacent the roller and adapted to receive selected ones of the warp members therein, means responsive to rotation of the roller for causing the heddle arrangements to undergo reciprocating sliding motion relative to the frame means, at least one rapier assembly mounted on the frame means and including a hollow member adapted to receive a fill member therein and mounted to undergo linear motion along an axis between the roller and the pair of heddle arrangements, means responsive to rotation of the roller for causing the hollow member to undergo reciprocating motion along the axis and means for periodically generating a quantity of pressurized air adjacent an open end of the hollow member in a direction to force a length of a fill member disposed within the hollow member out of the hollow member, the means for periodically generating a quantity of pressurized air including a second hollow member surrounding and including the first-mentioned hollow member therein and terminating in a nozzle surrounding the open end of the first-mentioned hollow member, means providing a source of pressurized air and means for periodically coupling the source of pressurized air to the inside of the second hollow member.

2. Apparatus for interweaving a pair of elongated fibrous fill members with a plurality of fibrous warp members to form a fabric for processing of the warp members comprising the combination of a generally vertically disposed frame of rectangular outline including a pair of generally parallel, spaced-apart side frames, a first pair of heddle guides, each generally vertically disposed on the inside of a different one of the side frames, a first heddle assembly including a first pair of heddle frames, each of which extends between and is received in the first pair of heddle guides, and a first plurality of heddle wires disposed generally vertically and extending between the first pair of heddle frames and in spaced-apart relation across the first pair of heddle frames and each including an aperture therein for receiving a fibrous member, the apertures of the first plurality of heddle wires lying along a first generally horizontal line, a second pair of heddle guides, each generally vertically disposed on the inside of a different one of the side frames adjacent and generally parallel to a different one of the first pair of heddle guides, a second heddle assembly including a second pair of heddle frames, each of which extends between and is received in the second pair of heddle guides, and a second plurality of heddle wires disposed generally vertically and extending between the second pair of heddle frames and in spaced-apart relation across the second pair of heddle frames and each including and aperture therein for receiving a fibrous member, the apertures of the second plurality of rods lying along a second generally horizontal line, means coupled to the first and second heddle assemblies for driving the first and second heddle assemblies within the first and second pairs of heddle guides in reciprocating fashion such that the first and second lines in which the apertures of the first and second pluralities of rods lie move up and down in an out-of-phase relationship, at least one generally cylindrical roller extending between and mounted on the pair of side frames so as to be rotatable about a generally horizontal axis, a pair of guide assemblies, each mounted on the outside of and extending outwardly from a different one of the side frames, a pair of trolley assemblies, each disposed to undergo generally horizontal motion along a different one of the guide assemblies, a pair of elongated hollow rapier assemblies, each coupled to a different one of the trolley assemblies and adapted to disperse a fibrous member therefrom and means coupled to drive each of the trolley assemblies along a different one of the guides assemblies in a reciprocating, cyclic motion, each of the pair of elongated, hollow rapier assemblies including a hollow outer tube, a nozzle coupled to one end of the hollow outer tube, a hollow inner tube disposed within the hollow outer tube, the inner tube adapted to receive a fibrous member therein and having a first end thereof disposed within the nozzle, a source of pressurized air coupled to the inside of the outer tube outside of the inner tube and means adjacent an opposite end of the hollow inner tube for storing a quantity of the fibrous member.

3. The invention set forth in claim 2, wherein the source of pressurized air includes a valve and means for operating the valve whenever the associated trolley assembly reaches a predetermined point adjacent the frame.

4. Apparatus for interweaving a pair of elongated fibrous fill members with a plurality of fibrous warp members to form a fabric for processing of the warp members comprising the combination of a generally vertically disposed frame of rectangular outline including a pair of generally parallel, spaced-apart side frames, a first pair of heddle guides, each generally vertically disposed on the inside of a different one of the side frames, a first heddle assembly including a first pair of heddle frames, each of which extends between and is received in the first pair of heddle guides, and a first plurality of heddle wires disposed generally vertically and extending between the first pair of heddle frames and in spaced-apart relation across the first pair of heddle frames and each including an aperture therein for receiving a fibrous member, the apertures of the first plurality of heddle wires lying along a first generally horizontal line, a second pair of heddle guides, each generally vertically disposed on the inside of a different one of the side frames adjacent and generally parallel to a different one of the first pair of heddle guides, a a second heddle assembly including a second pair of heddle frames, each of which extends between and is received in the second pair of heddle guides, and a second plurality of heddle wires disposed generally vertically and extending between the second pair of heddle frames and in spaced-apart relation across the second pair of heddle frames and each including an aperture therein for receiving a fibrous member, the apertures of the second plurality of rods lying along a second generally horizontal line, means coupled to the first and second heddle assemblies for driving the first and second heddle assemblies within the first and second pairs of heddle guides in reciprocating fashion such that the first and second lines in which the apertures of the first and second pluralities of rods lie move up and down in an out-of-phase relationship, at least one generally cylindrical roller extending between and mounted on the pair of side frames so as to be rotatable about a generally horizontal axis, a pair of guide assemblies, each mounted on the outside of an extending outwardly from a different one of the side frames, a pair of trolley assemblies, each disposed to undergo generally horizontal motion along a different one of the guide assemblies, a pair of elongated, hollow rapier assemblies, each coupled to a different one of the trolley assemblies and adapted to disperse a fibrous member therefrom, means coupled to drive each of the trolley assemblies along a different one of the guide assemblies in a reciprocating, cyclic motion, a second generally cylindrical roller disposed adjacent the at least one generally cylindrical roller and extending between and mounted on the pair of side frames so as to be rotatable about a generally horizontal axis, an elongated shaft disposed adjacent the second generally cylindrical roller and extending between and mounted on the pair of side frames so as to be rotatable about a generally horizontal axis, a pair of hollow, generally cylindrical members mounted on opposite ends of the shaft and disposed in contact with the second generally cylindrical roller, first and second cams coupled to the at least one generally cylindrical roller, a first cam operated valve disposed adjacent the first cam and coupled to operate the means for driving the first and second heddle assemblies and second and third cam operated valves disposed adjacent the second cam and coupled to operate the means coupled to drive each of the trolley assemblies.

5. The invention set forth in claim 4, wherein the means for driving the first and second heddle assemblies includes a pneumatically operated rotary actuator and the means coupled to drive each of the trolley assemblies includes second and third pneumatically operated rotary actuators coupled to the first and second trolley assemblies respectively.

6. The invention set forth in claim 5, wherein the means coupled to drive each of the trolley assemblies includes a different plurality of sprockets rotatably mounted on each of the guide assemblies, and a pair of endless chains, each engaging a different plurality of the sprockets and being coupled to one of the second and third pneumatically operated rotary actuators and an adjacent trolley assembly.

* * * * *